United States Patent [19]

Meijer

[11] 4,184,250

[45] Jan. 22, 1980

[54] CUTTER FOIL FOR DRY SHAVING APPARATUS

[75] Inventor: Albert J. Meijer, Drachten, Netherlands

[73] Assignee: U.S. Philips Corporation, New York, N.Y.

[21] Appl. No.: 894,755

[22] Filed: Apr. 10, 1978

Related U.S. Application Data

[63] Continuation of Ser. No. 753,182, Dec. 22, 1976, abandoned, which is a continuation of Ser. No. 607,794, Aug. 26, 1975, abandoned.

[30] Foreign Application Priority Data

Sep. 2, 1974 [NL] Netherlands ..... 7411603

[51] Int. Cl.[2] ..... B26B 19/04

[52] U.S. Cl. ..... 30/346.51

[58] Field of Search ..... 30/346.51; 76/104 R, 76/101 SM

[56] References Cited

U.S. PATENT DOCUMENTS

| | | | |
|---|---|---|---|
| 2,948,063 | 8/1960 | Jepson | 30/346.51 X |
| 3,064,349 | 11/1962 | Futterer | 30/346.51 X |
| 3,409,984 | 11/1968 | Futterer | 30/346.51 |
| 3,611,572 | 10/1971 | Futterer | 30/346.51 |
| 3,650,849 | 3/1972 | Nidetzky | 30/346.51 X |
| 3,881,373 | 5/1975 | Nakamura | 76/104 R |

FOREIGN PATENT DOCUMENTS

| | | | |
|---|---|---|---|
| 1452590 | 3/1969 | Fed. Rep. of Germany | 76/104 R |

*Primary Examiner*—Gary L. Smith

*Attorney, Agent, or Firm*—Thomas A. Briody; William J. Streeter; Rolf E. Schneider

[57] ABSTRACT

A cutter foil comprising a metal plate having apertures separated by partitions, each aperture being defined by a surrounding wall projecting inwardly of the plate, the thickness of the partitions being less than the thickness of the surrounding walls.

1 Claim, 2 Drawing Figures

CUTTER FOIL FOR DRY SHAVING APPARATUS

This application is a continuation of U.S. Ser. No. 753,182, filed Dec. 22, 1976, abandoned, which is a continuation of U.S. Ser. No. 607,794, filed Aug. 26, 1976, abandoned.

This invention relates to a cutter foil for a dry shaver having apertures separated by dams or partitions each consisting of a central portion adjoining edges or walls around the apertures, said edges projecting from the plane of the foil.

Such a cutter foil is known, for example, from U.S. Pat. No. 3,714,807.

In manufacturing a cutter foil comprising a thin metal plate having apertures obtained by means of punching, the dimensions of the dam or partition between two adjacent apertures are determined by the plate thickness. In cutter foils which have been made by electroforming, the foil thickness is also decisive of the dimensions of the dams. For good flexibility the cutter foil sould be as thin as possible. The driven lower knife or cutter which cooperates with the cutter foil engages the upright edges or walls around the apertures of the cutter foil. Said edges which form a part of the arc-shaped dam comprise sharp cutting sides. The upright edges at the circumferences of the apertures are formed either by punching or during the deposition of metal in the electroforming method. The thickness of the edges or walls is approximately equal to the foil thickness. When a very flexible foil is desired and hence a thin foil is chosen, the upright edges will also be thin and have a low rigidity. During use of the shaver the edges will soon wear away.

It is an object of the invention to provide a cutter foil which has a good flexibility and the upright aperture edges or walls of which are moreover sufficiently thick, and the invention is characterized in that the central portions of the dams or partitions have a smaller thickness than the edges.

The resulting flexible cutter foil presents a greater choice of possibilities as regards the shape in which the foil can be bent.

A preferred embodiment is characterized in that the central portions of the dams are ground away.

Figure 1:
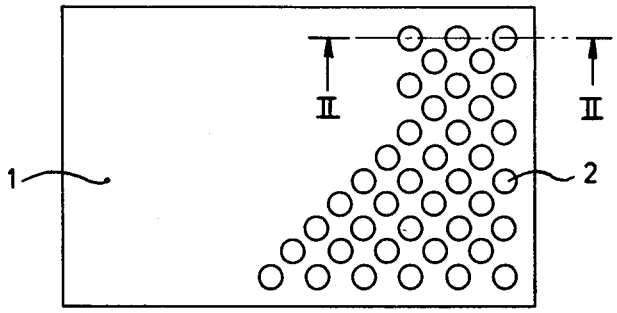
Figure 2:
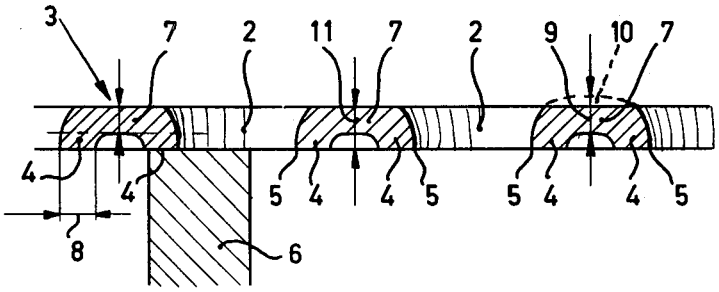

The invention will now be described in greater detail with reference to an embodiment of the cutter foil shown in the drawings, in which FIG. 1 is a plan view of the cutter foil, and FIG. 2 is a cross-sectional view on an enlarged scale of a part of the foil taken on the line II—II of FIG. 1.

FIG. 1 shows a cutter foil 1 which has apertures 2 and which has been obtained by punching holes in a thin metal plate or sheet or has been manufactured by electroforming. Both methods provide a cutter foil in which the cross-section of the connecting part or partition between two adjacent apertures is formed by an arc-shaped dam 3 (see FIG. 2). The upright edges or walls 4 formed during the manufacture are ground away only partly so that sharp cutting sides 5 are formed with which the lower knife or cutter 6 shown diagrammatically cooperates. The dam or partition 3 comprises a central portion 7 which adjoins the edges or walls 4 of the apertures on either side of the dam. The thickness 8 of the upright edges 4 will be approximately equal to the original plate thickness 9 both when manufacturing by punching and by electroforming. By grinding away the upper side 10 of the cutter foil, shown in broken lines, the central portion 7 of the arc-shaped dam 3 becomes thinner while the thickness 8 of the cutting edges or walls 4 is maintained. As a result of this the cutter foil 1 is more flexible and, for example, can be bent more easily into a shape having a small radius of curvature, while the rigidity of the edges around the apertures which is very important for a good cutting action is not deteriorated by the smaller thickness of the central portions of the dams.

By grinding away the upper side of the foil, the distance 11 between the upper side of the foil and the lower side of the cutting edges 4 becomes smaller so that the hairs will be cut shorter and the shaving result is improved.

What is claimed is:

1. A flexible cutter foil for use in a dry shaver, which comprises a metal plate having an outer surface and a parallel, opposite inner surface, a plurality of spaced apertures extending through said plate from said outer surface to said inner surface, plate partitions respectively separating adjacent apertures from each other, and walls respectively surrounding said apertures and formed integrally with said plate and projecting substantially perpendicular from the inner surface of said plate, said plate and walls consisting of a unitary structure formed solely from a single metallic material, the inner end of each surrounding wall being formed as a cutting edge, and the distance between the outer surface and the parallel, inner surface of said plate partitions being less than the distance between the opposite surfaces of said surrounding walls.

* * * * *